US009620902B2

(12) United States Patent
Tsai

(10) Patent No.: US 9,620,902 B2
(45) Date of Patent: Apr. 11, 2017

(54) CONNECTOR FIXING PIECE AND CONNECTOR MODULE USING CONNECTOR FIXING PIECE

(71) Applicant: AU Optronics Corporation, Hsin-Chu (TW)

(72) Inventor: Chia-Wen Tsai, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 15/023,922

(22) PCT Filed: Jan. 8, 2014

(86) PCT No.: PCT/CN2014/070290

§ 371 (c)(1),
(2) Date: Mar. 22, 2016

(87) PCT Pub. No.: WO2015/081619

PCT Pub. Date: Jun. 11, 2015

(65) Prior Publication Data

US 2016/0240972 A1 Aug. 18, 2016

(30) Foreign Application Priority Data

Dec. 6, 2013 (CN) ..... 2013 2 0806725 U

(51) Int. Cl.
*H01R 13/62* (2006.01)
*H01R 13/639* (2006.01)

(52) U.S. Cl.
CPC ..... *H01R 13/639* (2013.01)

(58) Field of Classification Search
CPC ..... H01R 13/639
USPC ..... 439/369, 347, 345
See application file for complete search history.

(56) References Cited

U.S. PATENT DOCUMENTS 5,066,244 A * 11/1991 Kato ..... H01R 13/641 439/489
5,425,653 A * 6/1995 Koiso ..... H01R 13/641 439/347
5,591,041 A * 1/1997 Cecil, Jr. ..... H01R 13/506 439/352

(Continued)

FOREIGN PATENT DOCUMENTS

CN 2709993 7/2005
CN 101055979 10/2007

(Continued)

*Primary Examiner* — Tulsidas C Patel
*Assistant Examiner* — Peter G Leigh
(74) *Attorney, Agent, or Firm* — WPAT, PC; Justin King

(57) ABSTRACT

A connector fixing piece comprises an engagement body, two cantilevers, a first buckle block, and a second buckle block. The engagement body is provided with a bottom surface. Two cantilevers project from the bottom surface of the engagement body to form a sleeve joint portion together. The first buckle block is located on the engagement body, and projects from the bottom surface of the engagement body. The second buckle block is located between the first buckle block and the two cantilevers, and projects from the bottom surface of the engagement body. By using the connector fixing piece of the present invention, the reliability of connector insertion connection can be improved.

10 Claims, 4 Drawing Sheets

(56) References Cited

U.S. PATENT DOCUMENTS 5,685,743 A * 11/1997 Schmidt ..... H01R 13/6272 439/352
6,250,952 B1 * 6/2001 Shiga ..... F42B 3/188 439/466
6,364,683 B1 * 4/2002 Kohno ..... H01R 13/639 439/188
6,530,799 B2 * 3/2003 Regnier ..... H01R 13/639 439/352
6,663,411 B2 * 12/2003 Little ..... H01R 13/501 439/188
6,705,886 B1 * 3/2004 Brown ..... H01R 13/641 439/352
6,811,424 B2 * 11/2004 Brown ..... H01R 13/639 439/188
6,893,277 B2 * 5/2005 Parrish ..... H01R 13/506 439/188
6,945,801 B2 * 9/2005 Brown ..... H01R 13/641 439/188
7,108,539 B2 * 9/2006 Gunreben ..... H01R 13/639 439/352
7,344,403 B2 * 3/2008 Major ..... H01R 13/6271 439/352
7,416,445 B1 * 8/2008 Brown ..... H01R 13/424 439/596
7,578,694 B2 * 8/2009 Takahashi ..... H01R 13/6273 439/352
8,062,056 B2 * 11/2011 Lee ..... H01R 4/2433 439/395
8,317,545 B2 * 11/2012 Iida ..... H01R 13/7197 439/352
8,939,799 B2 * 1/2015 Watanabe ..... H01R 13/627 439/686
9,071,011 B2 * 6/2015 Matsumoto ..... H01R 13/639
9,147,971 B2 * 9/2015 Osada ..... H01R 13/641
2002/0009924 A1 * 1/2002 Little ..... H01R 13/639 439/625
2002/0081888 A1 * 6/2002 Regnier ..... H01R 13/639 439/352
2007/0264863 A1 * 11/2007 Nakamura ..... H01R 13/641 439/489
2014/0045361 A1 * 2/2014 Gunreben ..... H01R 13/6273 439/345
2015/0037996 A1 * 2/2015 Chen ..... H01R 13/6273 439/345

FOREIGN PATENT DOCUMENTS

CN 201134572 10/2008
CN 201549669 8/2010
CN 201623419 11/2010
CN 102315570 1/2012

* cited by examiner

CONNECTOR FIXING PIECE AND CONNECTOR MODULE USING CONNECTOR FIXING PIECE

RELATED APPLICATIONS

This application is a continuation of International application No. PCT/CN2014/070290, filed on Jan. 8, 2014 which claims the benefits of priority of CN application No. 201320806725.0 filed on Dec. 6, 2013, the content of which are incorporated herein by reference.

BACKGROUND

Field of Invention

The present invention relates to a fixing piece, and more particularly, to a connector fixing piece and a connector module using the connector fixing piece.

Description of Related Art

In general, common methods for electrically connecting electronic devices include soldering, coupling, electromagnetic inducting or insertion connecting. Connectors have assembly and disassembly convenience, such that the connectors are usually applied to technique fields having assembly and disassembly requirements, such as a connection operation between cable lines of solar panels.

However, although the connector has the advantages including assembly and disassembly convenience and etc., the two connectors, which are inserted and connected to each other, are easily separated to cause a breaking problem when the connectors are pulled by an external force. Therefore, the industry generally uses a fixing piece (such as a cable tie, silicone, an iron wire or an adhesive tape) to increase the reliability of the two connectors, which are inserted and connected to each other. However, the existing fixing pieces have some problems. For example: (1) adhesive force of the tape is not sufficient and the adhesive of the tape easily remains on objects' surface; (2) it takes time to solidify the silicone, and the silicone does not have the assembly and disassembly convenience as the connectors; and (3) the operation of the iron wire and the cable tie is difficult, such that the assembly and disassembly efficiency is decreased. Thus, how to increase the reliability of connector insertion connection and the efficiency of fabricating the connectors and the fixing piece is one of the problems needed to be solved by the research and development personnel.

SUMMARY

In order to eliminate or improve at least one of the aforementioned disadvantages of the prior arts, an objective of the present invention is to provide a connector fixing piece and a connector module using the connector fixing piece to increase the reliability of connector insertion connection.

A connector fixing piece disclosed by the present invention comprises an engagement body, two cantilevers, a first buckle block and a second buckle block. The two cantilevers projects from two sides of the engagement body to form a sleeve joint portion together. The first buckle block is located on the engagement body, and projects from a bottom surface of the engagement body. The second buckle block is located between the first buckle block and the two cantilevers, and projects from the bottom surface of the engagement body.

Preferably, each of the cantilevers has a connection section, a buckle section and a guide section, in which the two connection sections are connected to the engagement body, the two buckle sections are respectively connected to ends of the two connection sections away from the engagement body, the two guide sections are respectively connected to ends of the two buckle sections away from the two connection sections, and each of the two guide sections has a guide arc surface.

Preferably, a buffer block is disposed between each of the buckle sections and each of the guide sections.

Preferably, the engagement body further comprises a limit block, in which the limit block projects from the bottom surface of the engagement body, and the limit block is located between the two cantilevers.

Preferably, the engagement body further comprises a plurality of reinforcing ribs, in which the reinforcing ribs are located on a surface of the engagement body opposite to the bottom surface.

A connector module disclosed by the present invention comprises a first electrical connector, a second electrical connector and a connector fixing piece. The first electrical connector has a first buckle slot. The second electrical connector has a second buckle slot. The second electrical connector is inserted in and electrically connected to the first electrical connector. The connector fixing piece comprises an engagement body, two cantilevers, a first buckle block and a second buckle block. The two cantilevers projects from two sides of the engagement body to form a sleeve joint portion. The two cantilevers surround and are buckled in the second electrical connector to put the sleeve joint portion around the second electrical connector. The first buckle block is located on the engagement body, and projects from a bottom surface of the engagement body. The first buckle block is buckled in the first buckle slot. The second buckle block is located between the first buckle block and the two cantilevers, and projects from the bottom surface of the engagement body. The second buckle block is buckled in the second buckle slot.

Preferably, each of the cantilevers has a connection section, a buckle section and a guide section, in which the two connection sections are connected to the engagement body, the two buckle sections are respectively connected to ends of the two connection sections away from the engagement body, the two guide sections are respectively connected to ends of the two buckle sections away from the two connection sections, and each of the two guide sections has a guide arc surface.

Preferably, a buffer block is disposed between each of the buckle sections and each of the guide sections.

Preferably, the bottom surface contacts the first electrical connector and the second electrical connector.

Preferably, a height of the first buckle block is not greater than a depth of the first buckle slot, and a height of the second buckle block is not greater than a depth of the second buckle slot.

Preferably, the engagement body further comprises a plurality of reinforcing ribs, in which the reinforcing ribs are located on a surface of the engagement body opposite to the bottom surface.

Preferably, the engagement body further comprises a limit block, in which the limit block projects from the bottom surface of the engagement body, the limit block is located between the two cantilevers, and the limit block resists against the second electrical connector.

The connector fixing piece and the connector module using the connector fixing piece of the present invention have the following advantages.

According to the connector fixing piece and the connector module using the connector fixing piece disclosed by the present invention, with the limitation of the first buckle block and the second buckle block, the first electrical connector and the second electrical connector can be tightly inserted and connected to each other, thereby preventing the first electrical connector and the second electrical connector from being separated from each other. Furthermore, the limit block provides a support effect to prevent the connector fixing piece from departing from the electrical connectors due to the pulling force and the twist force, thereby enhancing the fixing reliability between the connector fixing piece and the electrical connectors. Moreover, with the positioning and guiding of the cantilevers, the efficiency of fabricating the connector fixing piece and the electrical connectors can be enhanced.

The foregoing descriptions related to the summary of the invention and the following embodiments are used to exemplify and explain the principle of the present invention, and to provide further explanation for the claims of the present invention.

DETAILED DESCRIPTION

Figure 1:
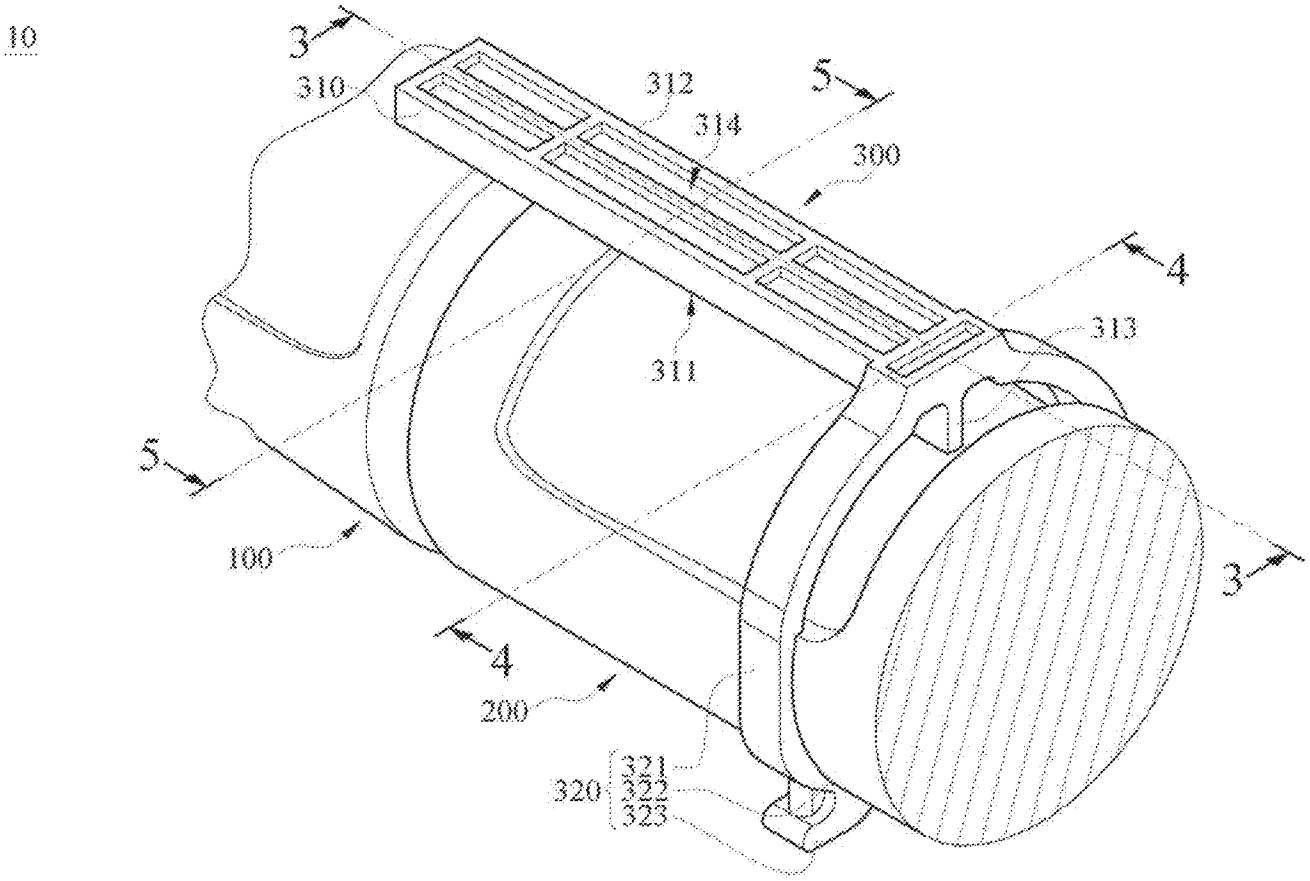
FIG. 1 is a schematic three-dimensional diagram of a connector module in accordance with a first embodiment of the present invention.
Figure 2:
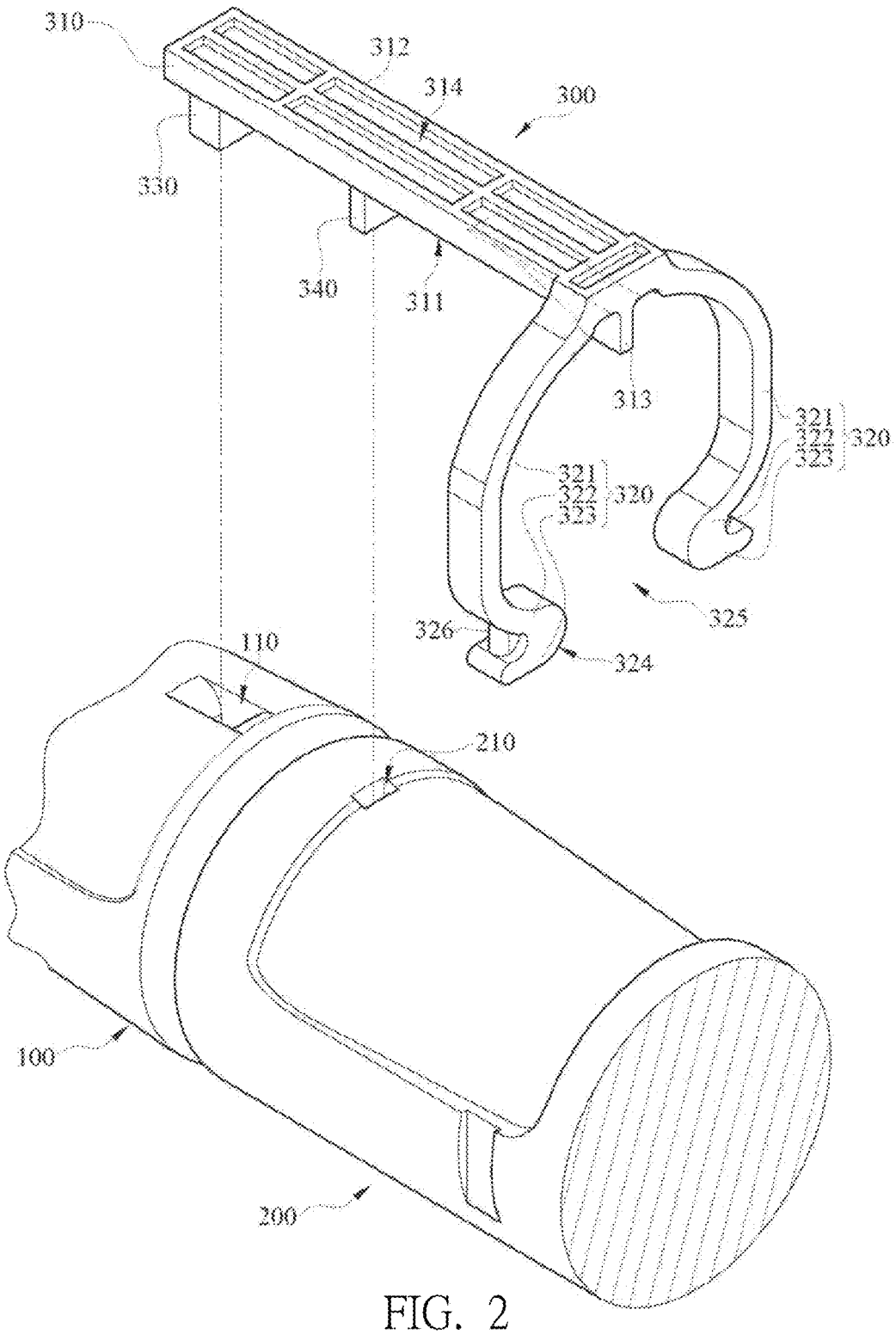
FIG. 2 is a schematic exploded view of FIG. 1.
Figure 3:
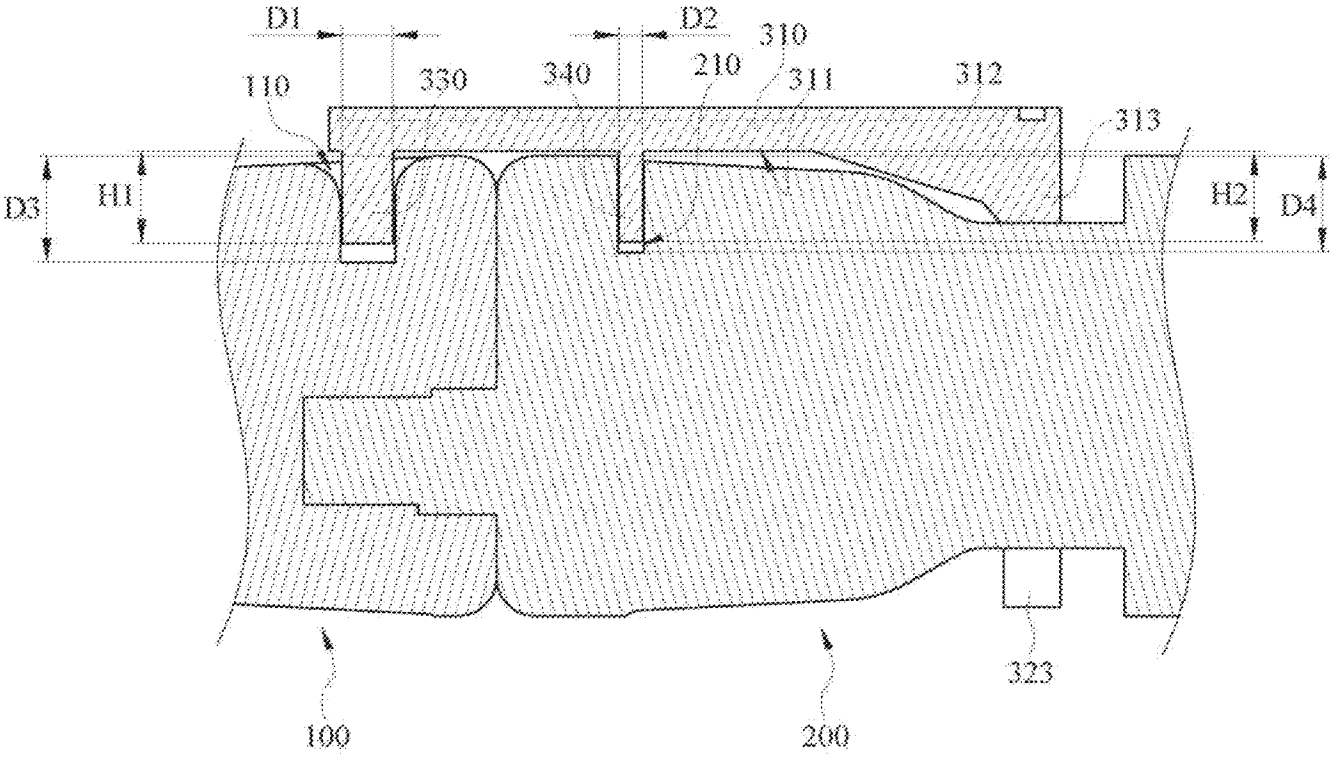
FIG. 3 is a cross-sectional view taken along a line 3-3 in FIG. 1.
Figure 4:
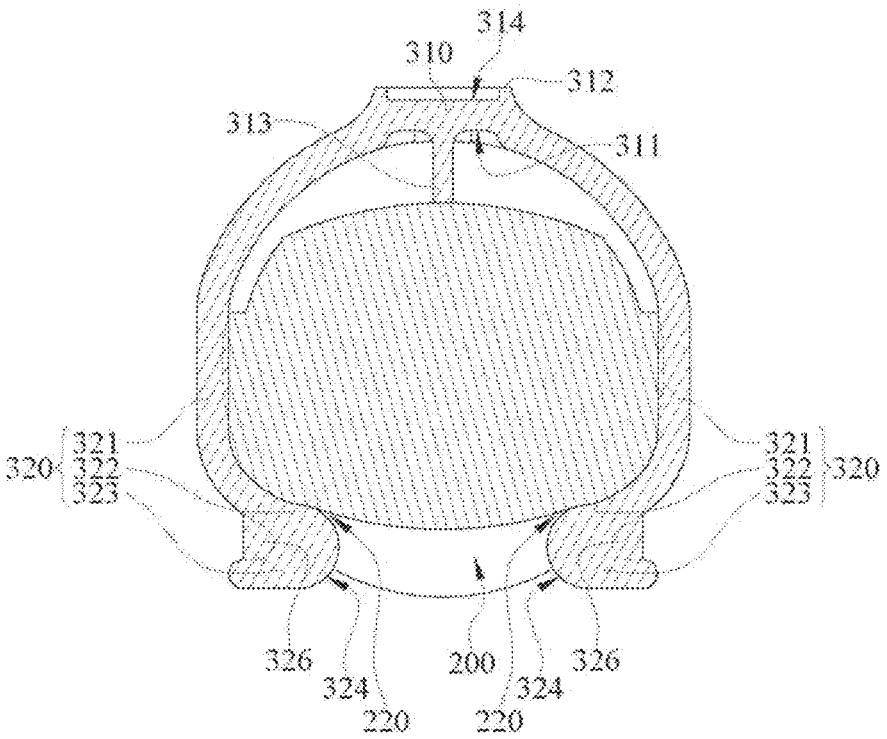
FIG. 4 is a cross-sectional view taken along a line 4-4 in FIG. 1.
Figure 5:
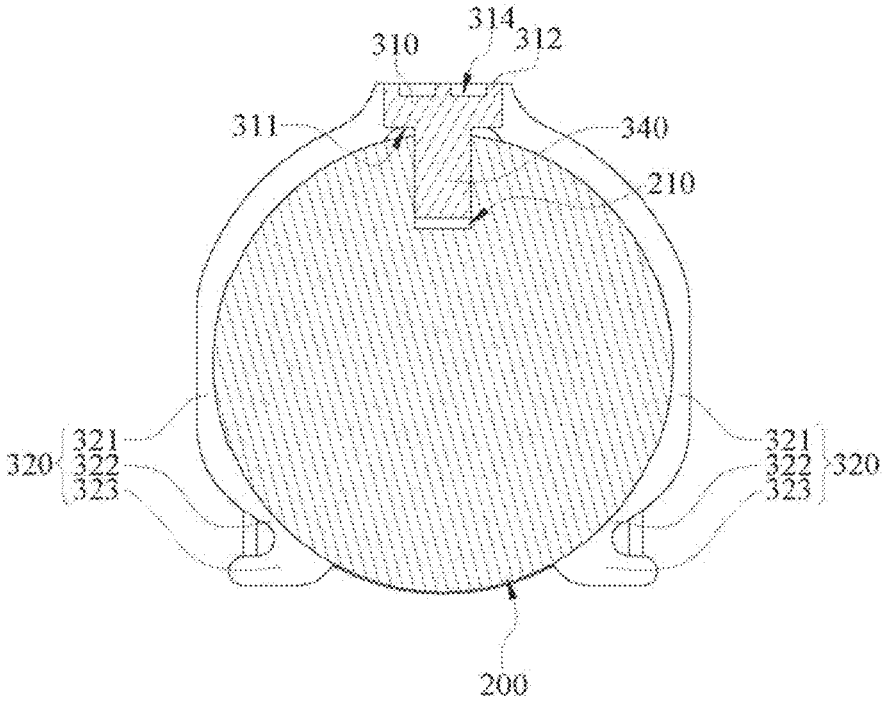
FIG. 5 is a cross-sectional view taken along a line 5-5 in FIG. 1.

Refer to FIG. 1 through FIG. 5. FIG. 1 is a schematic three-dimensional diagram of a connector module in accordance with a first embodiment of the present invention. FIG. 2 is a schematic exploded view of FIG. 1. FIG. 3 is a cross-sectional view taken along a line 3-3 in FIG. 1. FIG. 4 is a cross-sectional view taken along a line 4-4 in FIG. 1. FIG. 5 is a cross-sectional view taken along a line 5-5 in FIG. 1.

A connector module 10 of the present embodiment is applied on cable lines of solar panels, but not limited thereto. In other embodiments, the connector module 10 may be also applied on cable lines in other fields. The connector module 10 comprises a first electrical connector 100, a second electrical connector 200 and a connector fixing piece 300.

The first electrical connector 100 has a first buckle slot 110.

The second electrical connector 200 is inserted in and electrically connected to the first electrical connector 100. The second electrical connector 200 has a second buckle slot 210, and the second buckle slot 210 and the first buckle slot 110 are located on the same side of the connector module 10. The second electrical connector 200 further comprises two buckled portions 220 (as shown in FIG. 4). In the present embodiment, with the second buckle slot 210 being located on the top of the second electrical connector 200 as a datum, the two buckled portions 220 are respectively located on opposite sides of the lower of the second electrical connector 200.

The connector fixing piece 300 is fixed to the first electrical connector 100 and the second electrical connector 200. In detail, the connector fixing piece 300 comprises an engagement body 310, two cantilevers 320, a first buckle block 330 and a second buckle block 340.

The engagement body 310 has a bottom surface 311. In addition, the engagement body 310 further comprises a plurality of reinforcing ribs 312. The reinforcing ribs 312 are located on a surface 314 of the engagement body 310 opposite to the bottom surface 311 to reinforce the structure strength of the engagement body 310.

The two cantilevers 320 extend from the engagement body 310 toward the same side and project from two sides of the engagement body 310 to form a sleeve joint portion 325. The two cantilevers 320 surround the second electrical connector 200 together and are buckled in the two buckled portions 220 of the second electrical connector 200 to put the sleeve joint portion 325 around the second electrical connector 200. In detail, each of the cantilevers 320 has a connection section 321, a buckle section 322 and a guide section 323. The two connection sections 321 are connected to the engagement body 310. The two buckle sections 322 are respectively connected to ends of the two connection sections 321 away from the engagement body 310. The two guide sections 323 are respectively connected to ends of the two buckle sections 322 away from the connection sections 321. Each of the two guide sections 323 has a guide arc surface 324 for guiding the second electrical connector 200 to be buckled between the two cantilevers 320, so as to respectively buckle the two buckle sections 322 in the two buckled portions 220 of the second electrical connector 200 (as shown in FIG. 4) after the second electrical connector 200 being buckled between the two cantilevers 320. Thus, in the fabrication of the connector fixing piece 300, a fabricator can buckle the first buckle block 330 and the second buckle block 340 in the first buckle slot 110 and the second buckle slot 210 rapidly and respectively through the positioning and guiding of the cantilevers 320, thereby enhancing the fabrication efficiency of the connector fixing piece 300 and the electrical connectors.

It is worthy to be noted that the second electrical connector 200 has two buckled portions 220 and the cantilevers 320 have two buckle sections 322, such that a buckling effect between the second electrical connector 200 and the connector fixing piece 300 can be further increased. But, it is not limited thereto. In other embodiments, the second electrical connector 200 may not have two buckled portions 220, and the cantilevers 320 may not have two buckle sections 322, and the fabrication is completed by simply putting the two cantilevers 320 around the second electrical connector 200.

In addition, in the present embodiment and the other embodiments, a buffer block 326 is disposed between each of the buckle sections 322 and each of the guide sections 323 to increase the structure strength of the connections of the buckle sections 322 and the guide sections 323. In detail, the two buckle sections 322 extend inwardly (approach to each other), and the two guide sections 323 extend outwardly (are away from each other), such that the combination of the buckle section 322 and the guide section 323 is in a U-shape. The buffer blocks 326 are located on sides of the buckle sections 322 and the guide sections 323 opposite to the second electrical connector 200.

Furthermore, the engagement body 310 further comprises a limit block 313, and the limit block 313 is located between the two cantilevers 320. The limit block 313 projects from the bottom surface 311 of the engagement body 310 and resists against a top surface of the second electrical connector 200, such that the limit block 313 and the two guide sections 323 resist against the second electrical connector 200 together to form a three-point fixing effect (as shown in FIG. 4), thereby increasing the reliability of fixing the connector fixing piece 300 to the second electrical connector 200.

Moreover, because the expanding stress easily concentrates on the connection between the two cantilevers 320, the present embodiment sets the limit block 313 between the two cantilevers 320 to increase a thickness of the connection of the two cantilevers 320, thereby increasing the structure strength of the connection between the two cantilevers 320.

The first buckle block 330 is located on the engagement body 310 and projects from the bottom surface 311 of the engagement body 310. The first buckle block 330 is buckled in the first buckle slot 110.

The second buckle block 340 is located between the first buckle block 330 and the two cantilevers 320, and projects from the bottom surface 311 of the engagement body 310. The second buckle block 340 is buckled in the second buckle slot 210.

It is worthy to be noted that a height H1 of the first buckle block 330 of the present embodiment projecting from the bottom surface 311 is not greater than a depth D3 of the first buckle slot 110, and a height H2 of the second buckle block 340 projecting from the bottom surface 311 is not greater than a depth D4 of the second buckle slot 210. Thus, when the first buckle block 330 and the second buckle block 340 are respectively buckled in the first buckle slot 110 and the second buckle slot 210, the bottom surface 311 of the engagement body 310 can contact the first electrical connector 100 and the second electrical connector 200, thereby enhancing the fixing effect among the first electrical connector 100, the second electrical connector 200 and the connector fixing piece 300.

In the present embodiment, an outer diameter D1 of the first buckle block 330 is greater than an outer diameter D2 of the second buckle block 340 (as shown in FIG. 3), such that the second buckle block 340 having the smaller outer diameter can match with electrical connectors of various specifications. But, it is not limited thereto. In other embodiments, the outer diameter of the first buckle block 330 may be smaller than the outer diameter of the second buckle block 340, or the outer diameters of the first buckle block 330 and the second buckle block 340 are of small sizes, thereby broadening commonness of the connector fixing piece 300.

It is worthy to be noted that both the first buckle block 330 and the second buckle block 340 are fixed on the engagement body 310 to make the first buckle block 330 and the second buckle block 340 have a constant gap, and the gap is designed to be equal to or be slightly smaller than a gap between the first buckle slot 110 and the second buckle slot 210. Thus, the first buckle block 330 can tightly resist against a sidewall of the first buckle slot 110 adjacent to the bottom surface 311 and the second electrical connector 200, and the second buckle block 340 can tightly resist against a sidewall of the second buckle slot 210 adjacent to the bottom surface 311 and the first electrical connector 100, thereby forcing the first electrical connector 100 and the second electrical connector 200 to be inserted and connected tightly, and preventing the first electrical connector 100 and the second electrical connector 200 from being separated with each other.

Furthermore, when the two electrical connectors are pulled by the external force, the first electrical connector 100 and the second electrical connector 200 are tightly inserted and connected due to the limitation of the first buckle block 330 and the second buckle block 340, and the limit block 313 further provides a support effect to suppress a seesaw phenomenon caused by the pulling force and the twist force. Thus, it can prevent the connector fixing piece 300 from departing from the electrical connectors due to the pulling force and the twist force, thereby enhancing the fixing reliability between the connector fixing piece 300 and the electrical connectors.

INDUSTRIAL APPLICABILITY

According to the connector fixing piece and the connector module using the connector fixing piece disclosed by the present invention, with the limitation of the first buckle block and the second buckle block, the first electrical connector and the second electrical connector can be tightly inserted and connected to each other, thereby preventing the first electrical connector and the second electrical connector from being separated from each other. Furthermore, the limit block provides a support effect to prevent the connector fixing piece from departing from the electrical connectors due to the pulling force and the twist force, thereby enhancing the fixing reliability between the connector fixing piece and the electrical connectors. Moreover, with the positioning and guiding of the cantilevers, the efficiency of fabricating the connector fixing piece and the electrical connectors can be enhanced.

Although the embodiments of the present invention have been described as above, the invention should not be limited to the description of the embodiments contained herein. The person of ordinary skill in the art can make modifications partially to the shapes, structures, characteristics and quantity recited in the appended claims without departing from the spirit and scope of the present invention. Thus, the scope of the present invention should be determined by the scope defined in the appended claims.

What is claimed is:

1. A connector fixing piece, comprising:

an engagement body;

two cantilevers projecting from two sides of the engagement body to form a sleeve joint portion together, wherein each of the cantilevers has a connection section, a buckle section and a guide section, wherein the two connection sections are connected to the engagement body, the two buckle sections are respectively connected to ends of the two connection sections away from the engagement body, the two guide sections are respectively connected to ends of the two buckle sections away from the two connection sections, and each of the two guide sections has a guide arc surface, wherein the two buckle sections extend toward each other, and the two guide sections extend away from each other;

a first buckle block located on the engagement body, and projecting from a bottom surface of the engagement body; and a second buckle block located between the first buckle block and the two cantilevers, and projecting from the bottom surface of the engagement body.

2. The connector fixing piece according to claim 1, wherein a buffer block is disposed between each of the buckle sections and each of the guide sections.

3. The connector fixing piece according to claim 1, wherein the engagement body further comprises a limit block, the limit block projects from the bottom surface of the engagement body, and the limit block is located between the two cantilevers.

4. The connector fixing piece according to claim 1, wherein the engagement body further comprises a plurality of reinforcing ribs, and the reinforcing ribs are located on a surface of the engagement body opposite to the bottom surface.

5. A connector module, comprising:

a first electrical connector having a first buckle slot;

a second electrical connector having a second buckle slot, wherein the second electrical connector is inserted in and electrically connected to the first electrical connector; and a connector fixing piece comprising:

an engagement body;

two cantilevers projecting from two sides of the engagement body to form a sleeve joint portion, wherein the two cantilevers surround and are buckled in the second electrical connector to put the sleeve joint portion around the second electrical connector;

a first buckle block located on the engagement body, and projecting from a bottom surface of the engagement body, wherein the first buckle block is buckled in the first buckle slot; and a second buckle block located between the first buckle block and the two cantilevers, and projecting from the bottom surface of the engagement body, wherein the second buckle block is buckled in the second buckle slot, and wherein the bottom surface contacts the first electrical connector and the second electrical connector.

6. The connector module according to claim 5, wherein each of the cantilevers has a connection section, a buckle section and a guide section, wherein the two connection sections are connected to the engagement body, the two buckle sections are respectively connected to ends of the two connection sections away from the engagement body, the two guide sections are respectively connected to ends of the two buckle sections away from the two connection sections, and each of the two guide sections has a guide arc surface.

7. The connector module according to claim 6, wherein a buffer block is disposed between each of the buckle sections and each of the guide sections.

8. The connector module according to claim 5, wherein a height of the first buckle block is not greater than a depth of the first buckle slot, and a height of the second buckle block is not greater than a depth of the second buckle slot.

9. The connector module according to claim 5, wherein the engagement body further comprises a plurality of reinforcing ribs, and the reinforcing ribs are located on a surface of the engagement body opposite to the bottom surface.

10. The connector module according to claim 5, wherein the engagement body further comprises a limit block, wherein the limit block projects from the bottom surface of the engagement body, the limit block is located between the two cantilevers, and the limit block resists against the second electrical connector.

* * * * *